US006520394B2

(12) United States Patent
Ulibarri

(10) Patent No.: US 6,520,394 B2
(45) Date of Patent: Feb. 18, 2003

(54) PILOT PAD

(76) Inventor: Christopher Ulibarri, 5526 Castle Rd., Abilene, TX (US) 79606

( * ) Notice: Subject to any disclaimer, the term of this patent is extended or adjusted under 35 U.S.C. 154(b) by 0 days.

(21) Appl. No.: 09/829,627

(22) Filed: Apr. 10, 2001

(65) Prior Publication Data

US 2002/0145019 A1 Oct. 10, 2002

(51) Int. Cl.[7] ..... A45F 5/12
(52) U.S. Cl. ..... 224/627; 108/43; 224/222
(58) Field of Search ..... 224/267, 222; 108/43; 281/15.1, 22, 45; 206/38

(56) References Cited

U.S. PATENT DOCUMENTS

| | | | | | |
|---|---|---|---|---|---|
| 4,243,249 | A | * | 1/1981 | Goss | 108/43 |
| 4,998,185 | A | * | 3/1991 | DeNigris, Jr. | 108/43 |
| 5,388,530 | A | * | 2/1995 | Jacobus | 108/43 |
| 5,615,817 | A | * | 4/1997 | Shevers, Jr. | 108/43 |
| 5,788,575 | A | * | 8/1998 | Fluster | 108/43 |
| 5,937,765 | A | * | 8/1999 | Stirling | 108/43 |

* cited by examiner

*Primary Examiner*—Stephen K. Cronin
*Assistant Examiner*—Maerena W. Brevard
(74) *Attorney, Agent, or Firm*—Michael I. Kroll

(57) ABSTRACT

A pad for allowing a user to write comfortably and legibly on a leg. The pad includes a plurality of sheets adapted to be written upon, each sheet having a plurality of spaced diagonal writing guide lines extending across a width thereof. A base section is provided with a clip connected thereto for selectively retaining the sheets on the base. A latching mechanism releasably secures the base section to a leg of a user allowing notes to be written between the lines on a top sheet while seated with an arm in a comfortable writing position. The plurality of lines on each sheet extend upward from a left side to a right side to accommodate a right hand person or extend downward from a left side of to a right side to accommodate a left handed person. The lines are preferably inclined at an angle of between substantially twenty five to substantially thirty five degrees. A heading is printed near a top edge of each sheet, the heading being a visual flight rules/instrument flight rules form. The base section further includes a base and a knee board connected to the base in an angularly adjustable manner, the clip selectively securing the sheets to the knee board.

13 Claims, 7 Drawing Sheets

PILOT PAD

BACKGROUND OF THE INVENTION

1. Field of the Invention

The present invention relates generally to writing pads and, more specifically, to a pad of paper retained on a platform unobtrusively held on the leg of a pilot during flight and adapted to compensate for the position of the leg and the angle at which the pilot writes in a seated position thereby allowing the pilot to write legible notes thereon.

2. Description of the Prior Art

Numerous different types of paper pads have been provided in prior art. For example, U.S. Pat. No. 621,583 to Read; U.S. Pat. No. 1,677,930 to Prosser; U.S. Pat. No. 2,647,766 to Cordone and U.S. Pat. No. 3,352,572 to Swenson all are illustrative of such prior art. While these units may be suitable for the particular purpose to which they address, they would not be as suitable for the purposes of the present invention as heretofore described.

U.S. Pat. No. 621,583

Issued: Mar. 21, 1899

Inventor: Jacob L. Read

As an article of manufacture, a sheet of writing paper having a plurality of distinct horizontal parallel lines thereon. A plurality of indistinct parallel diagonal lines are disposed in crossing relation relative to the distinct lines. The indistinct lines being watermarks and becoming distinct when the sheet is supported to permit light to pass therethrough.

U.S. Pat. No. 1,677,930

Issued: Jul. 24, 1928

Inventor: Henry G. Prosser

A ledger or similar book provided with an auxiliary leaf. The latter having a column for names in accordance with the pages of the book and a separate balance sheet removably secured to the leaf. The latter being provided with a recess in which the sheet is seated, and shoulders at the sides of the recess within which the sides of the sheet are inclosed.

U.S. Pat. No. 2,647,766

Issued: Aug. 14, 1953

Inventor: Marcelin Cordone

A book containing classified matter in tabular form and comprising a plurality of superimposed group of leaves each constituted by superimposed leaves in mutual registration. The groups of leaves having all the same width and being echeloned in a direction away from a common support. At least all but the last one of the superimposed leaves of each group of leaves being cut away along an edge thereof, so as to provide a series of reference-bearing tabs extending in succession substantially from end to end of the edge of that group. The tabs extending in terraced form from said edge, so as to form a thumb index which extends from end to end of the edge of successive groups of leaves throughout the book.

U.S. Pat. No. 3,352,572

Issued: Nov. 14, 1967

Inventor: Julius A. Swenson

A portable writing pad comprising a plurality of assembled superimposed sheets adapted to be written upon in succession with each sheet adapted to produce a body of written material skewed to the edges of the pad. Each of the sheets being of rectangular shape having a pair of elongated side edges extending in spaced parallel relation to one another and also having parallel top and bottom edges extending at right angles to the side edges. Each of the writing sheets in the pad having a plurality of writing lines thereon extending in parallel relation to one another between the side edges, the writing lines each defining an angle of between one degree and nine degrees to the top and bottom edges.

SUMMARY OF THE PRESENT INVENTION

The present invention relates generally to writing pads and, more specifically, to a pad of paper retained on a platform unobtrusively held on the leg of a pilot during flight and adapted to compensate for the position of the leg and the angle at which the pilot writes in a seated position thereby allowing the pilot to write legible notes thereon.

A primary object of the present invention is to provide a pilot pad that will overcome the shortcomings of prior art devices.

Another object of the present invention is to provide a pilot pad which is able to provide a writing surface for a pilot which is readily accessible and unobtrusive.

A further object of the present invention is to provide a pilot pad which is able to be adjusted to sit at an angle to the leg of the pilot and thus conform with a comfortable writing position for the pilot.

A yet further object of the present invention is to provide a pilot pad wherein lines printed on each of the sheets of paper forming the pad extend at a diagonal to the sides of the pad whereby the pilot need not contort a writing arm to write legibly within the lines on the pad.

A still further object of the present invention is to provide a pilot pad wherein the diagonal writing guide lines extend at an angle of between twenty five to thirty five degrees from the horizontal for either a right handed or left handed pilot, so that the pilot can comfortably take notes while sitting in a cockpit of an aircraft when flying.

An even further object of the present invention is to provide a pilot pad including an angularly adjustable knee board strapped to the pilots leg for providing a flat rigid surface on which the pilot can write.

A yet object of the present invention is to provide a pilot pad which is able to reduce crew fatigue and minimize wrist strain caused by conventional arm pads used by pilots and thereby free the arms of the pilot to operate the throttle, flaps, trim inputs and other aircraft operations.

Another object of the present invention is to provide a pilot pad for allowing a pilot to readily take notes, such as writing down air traffic control clearances, radio frequencies, etc. while flying.

A still further object of the present invention is to provide a pilot pad which is able to be positioned on a knee of the pilot without disrupting the position of the pilot's legs required to control the plane as the legs of the pilot are brought together so that the knee's are about six inches apart for accessing the aircraft's rudder controls.

An even further object of the present invention is to provide a pilot pad including a heading with a visual flight rules/instrument flight rules form with spaces to put in aircraft type, tail number, ATIS, ground tower, approach/departure frequencies, altitude, heading and a squawk number on each sheet of paper.

An additional object of the present invention is to provide a pilot pad wherein each sheet also includes a visual flight rules/instrument flight rules heading form printed at the top thereof to be filled in by the pilot.

A yet further object of the present invention is to provide a pilot pad that is simple and easy to use.

A still further object of the present invention is to provide a pilot pad that is economical in cost to manufacture.

Additional objects of the present invention will appear as the description proceeds.

A pad for allowing a user to write comfortably and legibly on a leg is disclosed by the present invention. The pad includes a plurality of sheets adapted to be written upon, each sheet having a plurality of spaced diagonal writing guide lines extending across a width thereof. A base section is provided with a clip connected thereto for selectively retaining the sheets on the base. A latching mechanism releasably secures the base section to a leg of a user allowing notes to be written between the lines on a top sheet while seated with an arm in a comfortable writing position. The plurality of lines on each sheet extend upward from a left side to a right side to accommodate a right hand person or extend downward from a left side of to a right side to accommodate a left handed person. The lines are preferably inclined at an angle of between substantially twenty five to substantially thirty five degrees. A heading is printed near a top edge of each sheet, the heading being a visual flight rules/instrument flight rules form. The base section further includes a base and a knee board connected to the base in an angularly adjustable manner, the clip selectively securing the sheets to the knee board.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more filly appreciated as the same becomes better understood when considered in conjunction with the accompanying drawings, in which like reference characters designate the same or similar parts throughout the several views, and wherein.

Figure 1:
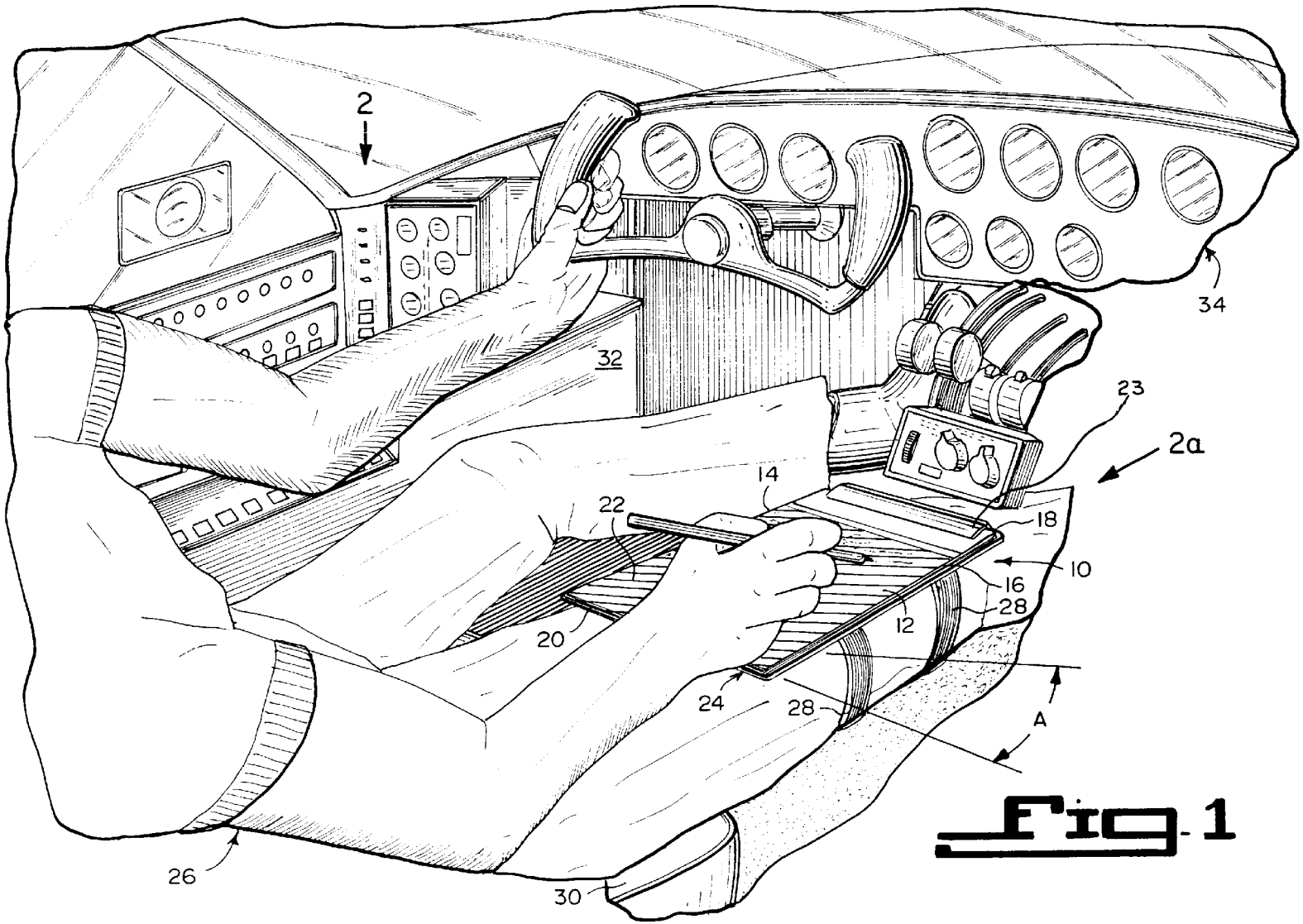
FIG. 1 is a perspective view of a pilot's leg including the pilot pad of the present invention strapped thereto.
Figures 2, 2A:
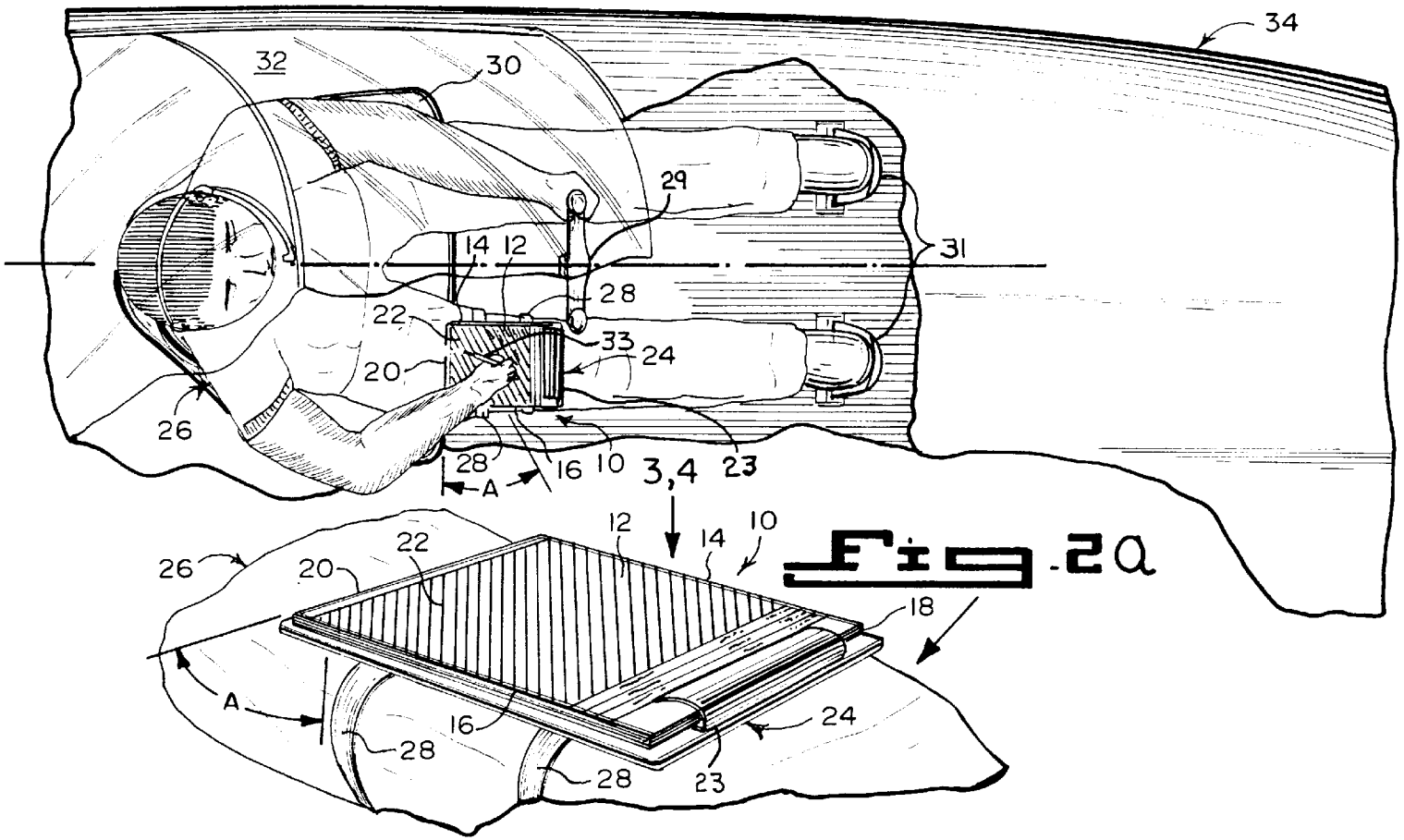
FIG. 2 is a top view taken in the direction of arrow 2 in FIG. 1 showing the pilot pad of the present invention strapped to the leg of the pilot.
Figure 3:
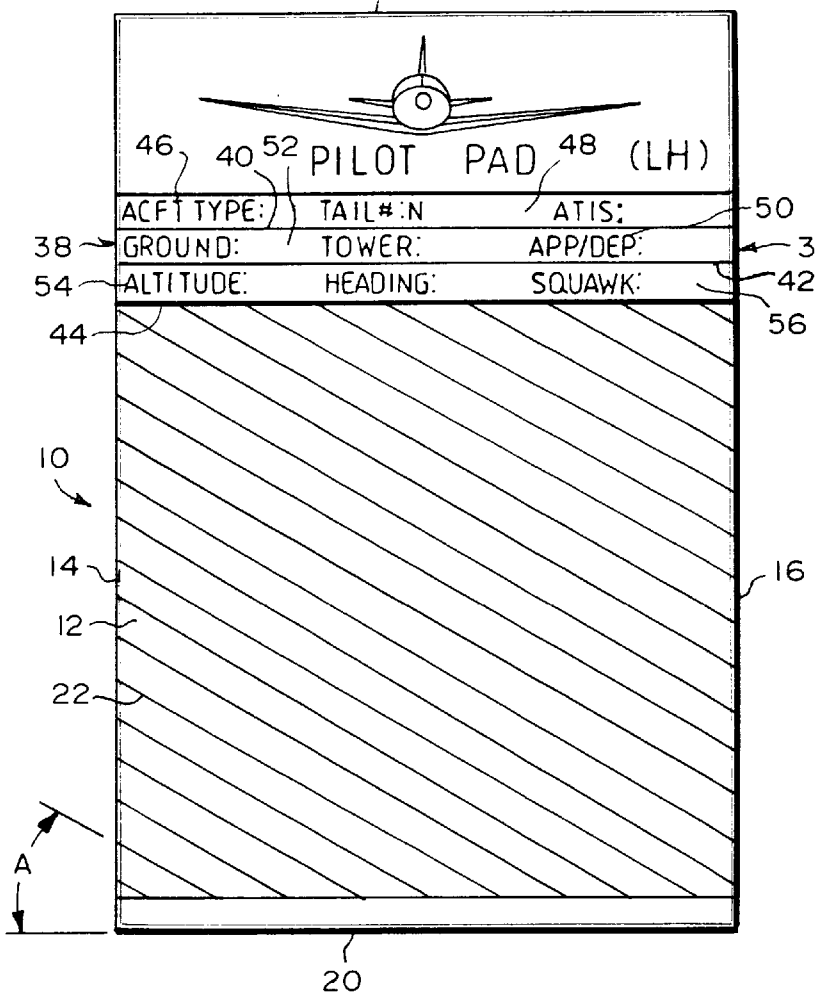

FIG. 2*a* is an enlarged perspective view of the pilot pad of the present invention strapped to the leg of the pilot taken in the direction of arrow 2*a* in FIG. 1;

FIG. 3 is an enlarged plan view of the pilot pad of the present invention including diagonal lines thereon adapted to the writing style of a left handed pilot, taken in the direction of arrow 3 in FIG. 2*a;*

Figure 4:
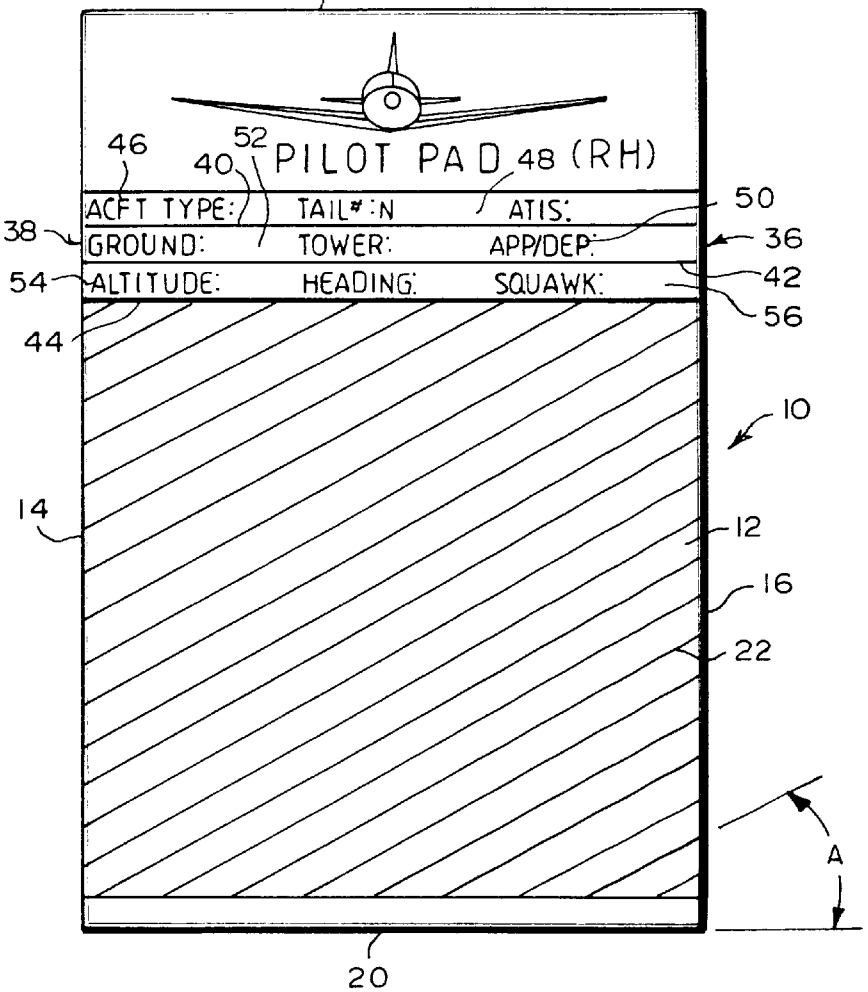

FIG. 4 is an enlarged plan view of the pilot pad of the present invention including diagonal lines thereon adapted to the writing style of a right handed pilot, taken in the direction of arrow 3 in FIG. 2*a;*

Figure 5:
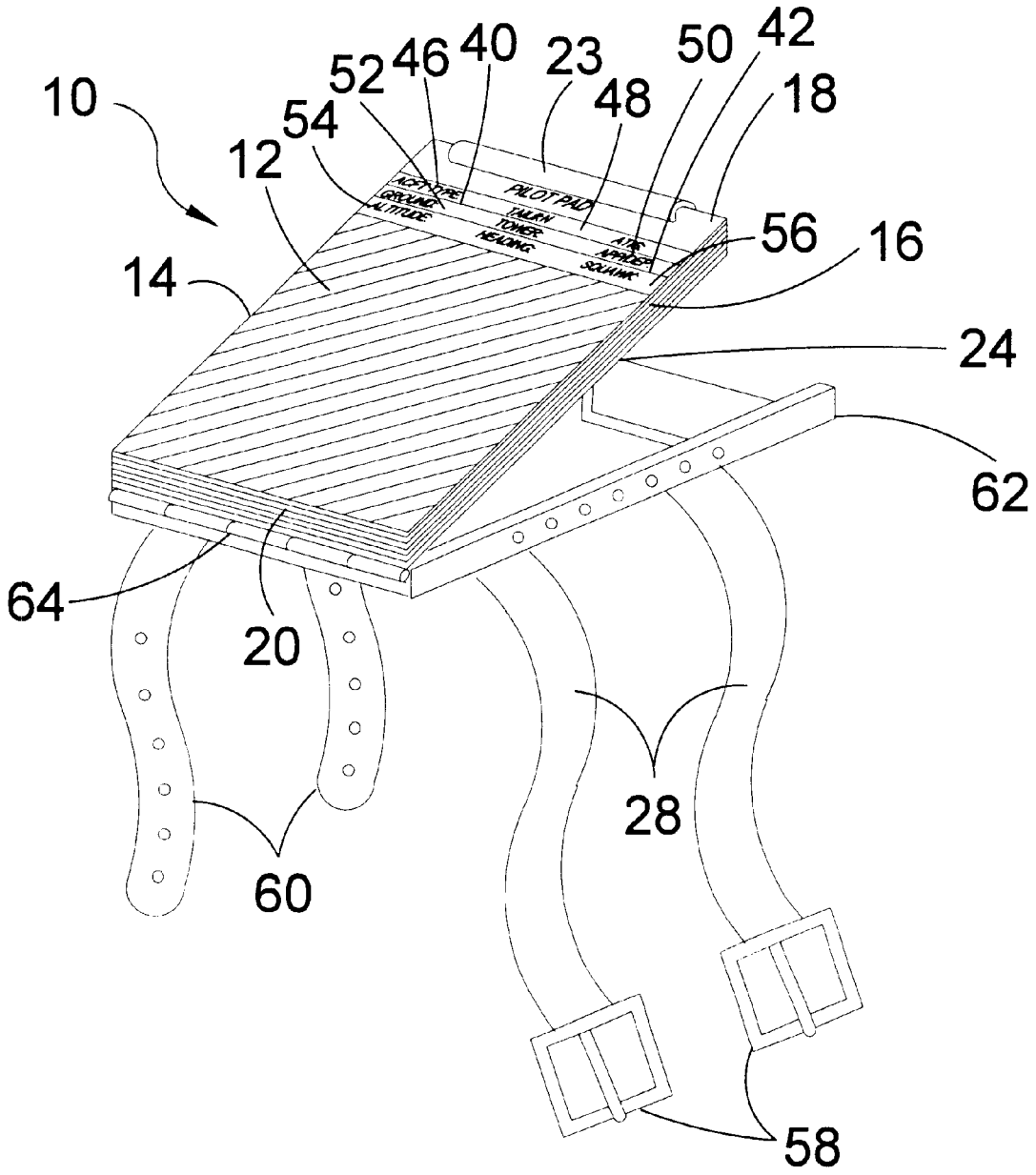
Figure 6:
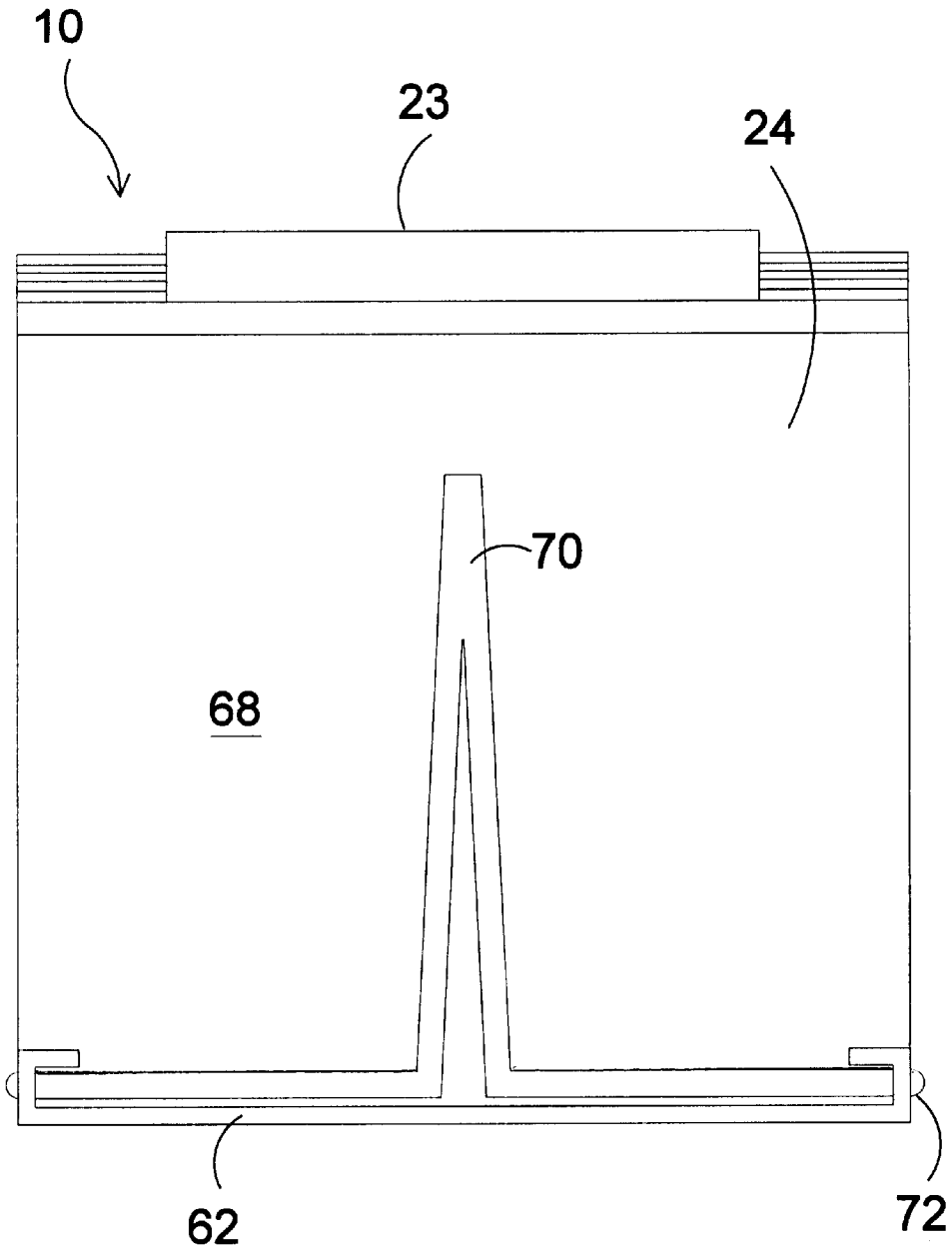
Figure 7:
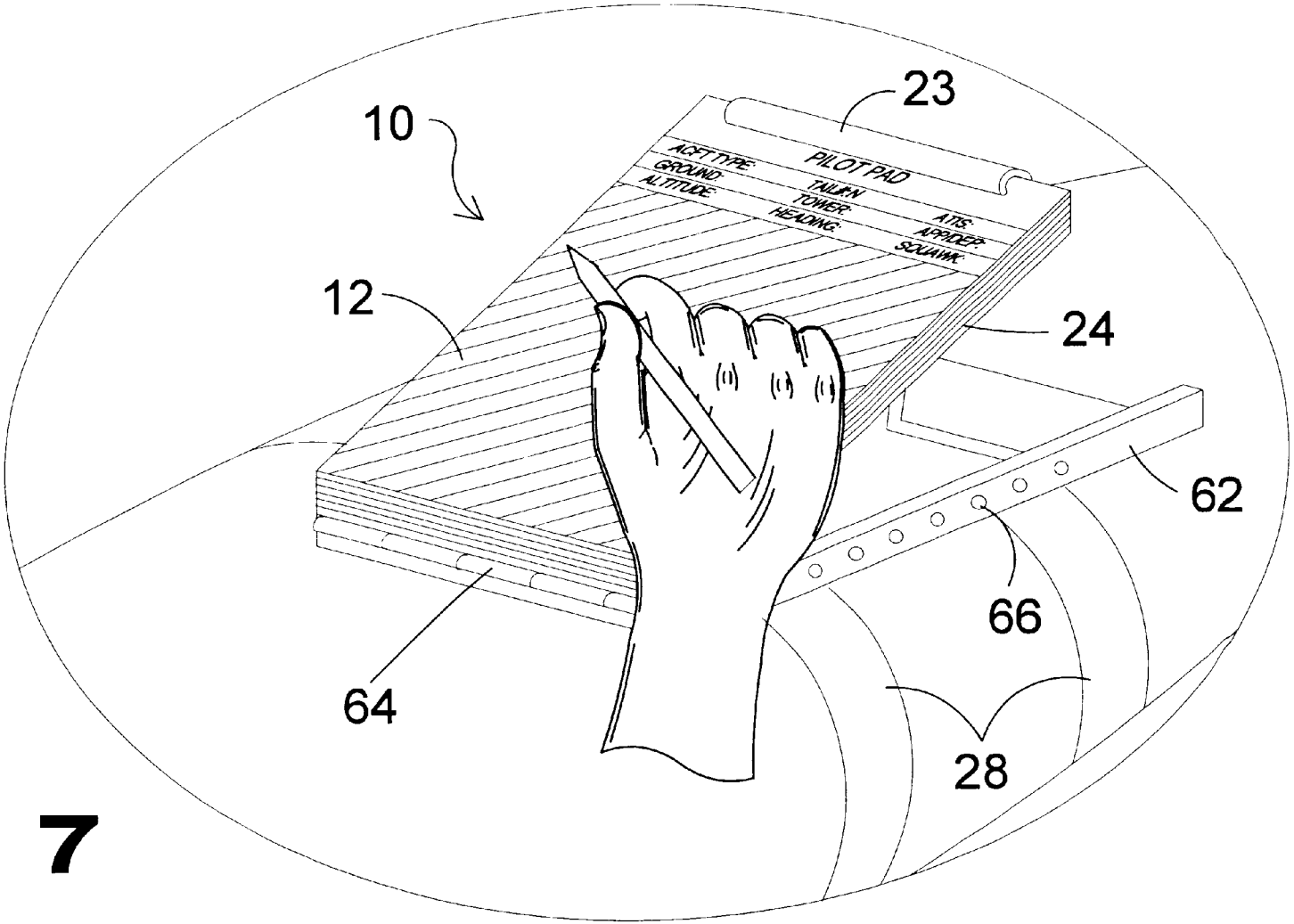
Figure 8:
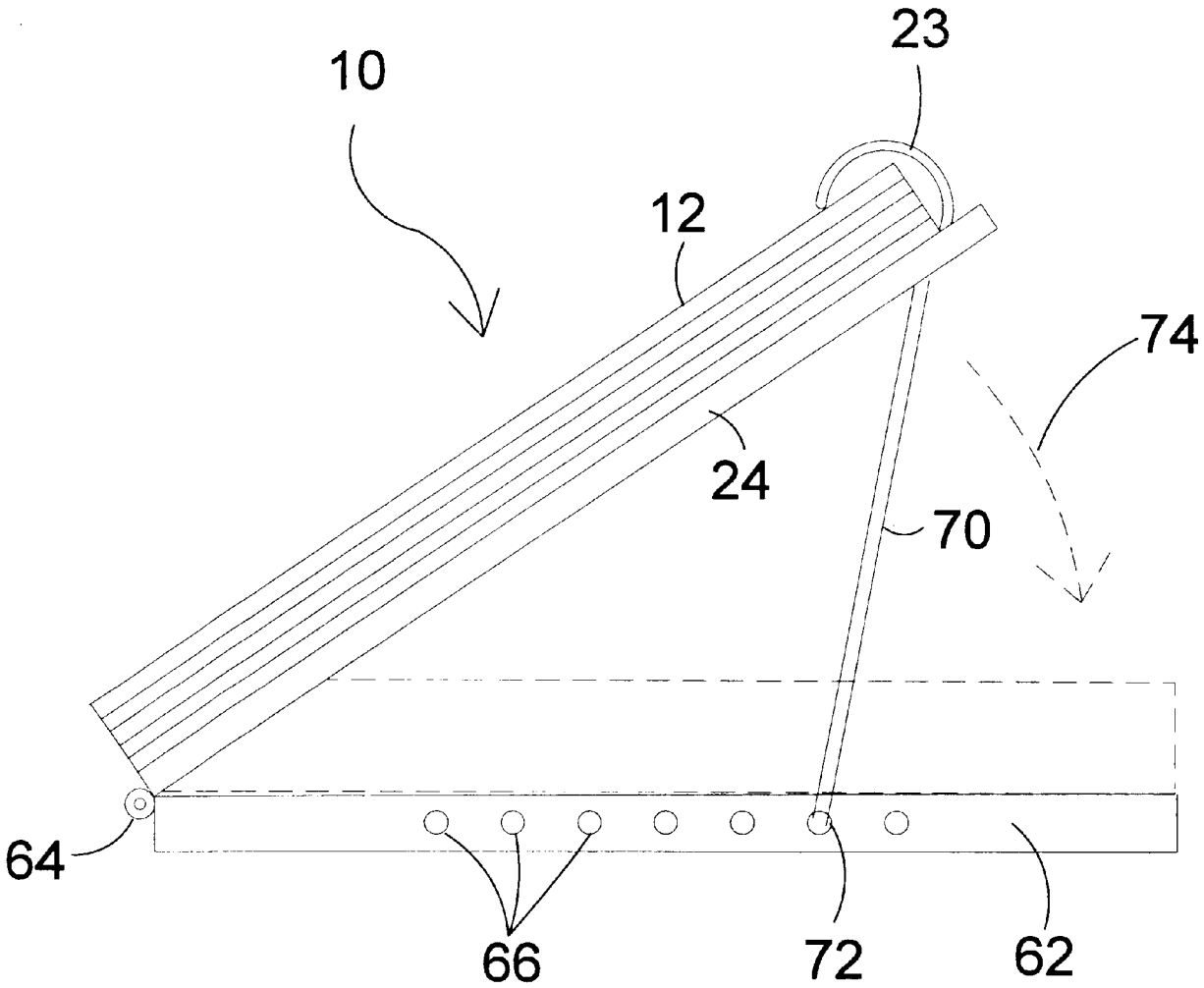

FIG. 5 is a side perspective view of the pilot pad of the present invention;

FIG. 6 is a back side view of the pilot pad of the present invention;

FIG. 7 is a perspective view of the pilot pad of the present invention strapped to a leg of a pilot and showing the pilot writing thereon; and FIG. 8 is a side view of the pilot pad of the present invention showing the pivotal movement of the angularly adjustable knee board.

DESCRIPTION OF THE REFERENCED NUMERALS

Turning now descriptively to the drawings, in which similar reference characters denote similar elements throughout the several views, the Figures illustrate the pilot pad of the present invention. With regard to the reference numerals used, the following numbering is used throughout the various drawing figures.

10 pilot pad of the present invention
12 sheet of paper on pilot pad
14 side edge of sheet of paper
16 side edge of sheet of paper
18 top edge of sheet of paper
20 bottom edge of sheet of paper
22 diagonal writing guide line on sheet of paper
23 clip
24 pilot knee board
26 pilot
28 strap of pilot knee board
29 steering wheel
30 seat in aircraft
31 rudder controls
32 cockpit of aircraft
33 pen/writing utensil
34 aircraft
36 heading on sheet of paper
38 visual flight rules/instrument flight rules for heading
40 first horizontal parallel line of heading
42 second horizontal parallel line of heading
44 third horizontal parallel line of heading
46 first indicia of first horizontal parallel line of heading
48 space of first horizontal parallel line of heading
50 second indicia of second horizontal parallel line of heading
52 space of second horizontal parallel line of heading
54 third indicia of third horizontal parallel line of heading
56 space of third horizontal parallel line of heading
58 buckle on end of strap
60 recesses on end of strap
62 base
64 hinge connecting base and knee board
66 recesses in base
68 back side of knee board
70 V-shaped stand
74 arrow indicating pivotal movement of knee board

DETAILED DESCRIPTION OF THE PREFERRED EMBODIMENT

Turning now descriptively to the drawings, in which similar reference characters denote similar elements throughout the several views, FIGS. 1 through 8 illustrate a pilot pad 10 of the present invention.

The pilot pad 10 of the present invention is shown in FIG. 1 releasably secured to a leg of a pilot 26. As can be seen from this figure, the pilot pad 10 includes a plurality of sheets of paper 12 forming a pad and adapted to be written upon. Each sheet 12 has a pair of side edges 14 and 16 extending in spaced parallel relation to one another, a top edge 18 extending between and perpendicular to the pair of side edges 14 and 16 and a bottom edge 20 extending between and perpendicular to the pair of side edges 14 and 16 at an end of the side edges 14 and 16 opposite the top edge 18. Each sheet 12 in the pilot pad 10 includes a plurality of diagonal writing guide lines 22, preferably inclined at an angle of between substantially twenty five to substantially thirty five degrees to the top and bottom edges 18 and 20. The angle at which the diagonal writing lines 22 extend is indicated by the letter A. The pilot pad 10 includes a clip 23 for releasably securing the sheets of paper 12 to a knee board 24. Straps 28 extend from the knee board 24 for releasably securing the pilot pad 10 to a knee of a pilot 26. The pilot 26 can comfortably take notes on the top sheet 12, while sitting in a seat 30 in a cockpit 32 of an aircraft 34 when flying.

A top view of the pilot 26 writing on the pilot pad 10 is shown in FIG. 2. As can be seen from this view, the pilot pad 10 is releasably secured to the leg of the pilot 26 by the straps 28. The width of the pilot pad 10 is substantially equal to the width of the thigh of the pilot 26 and thus, the pilot pad 10 neither obstructs the ability of the pilot 26 to operate the steering wheel 29 nor causes the pilot to adjust the feet in order to contact the rudder controls 31. The pilot 26 is shown writing on the pilot pad 10 with a pen 33. The pilot 26 need not adjust the body in any manner in order to comfortably write between the lines 22 as the angle at which the lines 22 extend correspond with the natural manner in which a person writes when seated in the position of the pilot 26. The pilot 26 is able to steer with one hand while writing with the other and need not worry about the position of the pilot pad 10 or hold the pilot pad 10 in place.

An enlarged view of the pilot pad 10 attached to a leg is shown in FIG. 2*a*. As can be seen from this figure, the straps 28 are holding the pilot pad 10 to the thigh of the pilot 26. The sheets of paper 12 are held to the knee board 24 by the clip 23. Positioned on each sheet of paper 12 are the plurality of diagonally extending lines 22. The diagonally extending lines 22 extend in parallel spaced relation to each other from the first side edge 14 to the second side edge 16 of the sheet of paper 12. The diagonal nature of the lines allows for writing on the sheets of paper without the pilot having to adjust an arm or the pilot pad 10 when the pilot pad 10 is attached to the leg of the pilot and the pilot is in a seated position. The pilot is thus able to write legibly within the lines without making any adjustments from the seated position. The ability of the pilot to write and fly at the same time is thus not hampered.

A top side view of the pilot pad 10 designed for use by a left handed person is shown in FIG. 3 and a top side view of the pilot pad 10 designed for use by a right handed person is shown in FIG. 4. The diagonal lines on the pilot pad 10 shown in FIG. 3 extend downward from the left side edge 14 of the sheet of paper 12 to the right side edge 16 along a diagonal towards the bottom edge 20. These diagonal lines conform with the angle at which a left handed person would write on a sheet of paper positioned on their thigh when seated. The diagonal lines on the pilot pad 10 shown in FIG. 4 extend upward from the left side edge 14 of the sheet of paper 12 to the right side edge 16 along a diagonal towards the top edge 18. These diagonal lines conform with an angle at which a right handed person would write on a sheet of paper positioned on their thigh when seated. Each sheet 12 is of a rectangular shape with the left and right side edges 14 and 16, respectively, being of a greater length than the top and bottom edges 18, 20. The diagonal writing guide lines 22 can be substantially increased in length to allow for more writing placed thereupon by the pilot 26 by at least one of increasing the angle at which the lines extend and increasing the width of the pilot pad 10. Each sheet 12 is typically, but not limited to preferably a size of substantially five and three quarter (5¾) inches in width by seven and three quarter (7¾) inches in length. This size pilot pad 10 is able to fit comfortably on the leg of a pilot without being burdensome.

As seen in FIGS. 3 and 4, each sheet 12 includes a heading 36 printed near the top edge 18, which provides space for the pilot 26 to insert certain information concerning the particular flight. The heading 36 is in the form of a visual flight rules/instrument flight rules form 38. The heading 36 consists of three parallel lines labeled with the numerals 40, 42 and 44, respectively, extending horizontally between the left and right side edges 14 and 16 of the sheet 12.

The first horizontal parallel line 40 of the heading 36 contains a first set of indicia 46 to indicate aircraft type, tail number and ATIS. Spaces 48 are provided next to each piece of the first set of indicia 46. The pilot 26 will place the appropriate information within these spaces 48. The second horizontal parallel line 42 of the heading 36 includes a second set of indicia 50 to indicate ground, tower and approach/departure frequencies. Spaces 52 are provided next to each piece of the second set of indicia 50. The pilot 26 will place the appropriate information in these spaces 52. The third horizontal parallel line 44 of the heading 36 consists of a third set of indicia 54 to indicate altitude, heading and squawk number. Spaces 56 are provided next to each piece of the third set of indicia 54. The pilot 26 will place the appropriate information in these spaces 56.

A perspective view of the pilot pad 10 is illustrated in FIG. 5. Here the pilot pad 10 is shown detached from a leg of a pilot 26. A perspective view of the pilot pad 10 with the knee board 24 in an angled position and releasably secured to a leg of a pilot is shown in FIG. 7. The pilot pad 10 includes the plurality of sheets of paper 12 secured to the knee board 24 by the clip 23. The knee board 24 is pivotally connected to a base 62 by a hinge 64 thereby allowing the knee board 24 and the paper 12 held thereon to be pivoted to extend at an angle from the base 62. Extending from the base 62 are the straps 28 for releasably securing the pilot pad 10 to a leg of the pilot. The straps 28 have an adjustable latching mechanism for releasably securing the pilot pad 10 to the leg of a pilot. The adjustable latching mechanism shown in the figure includes a buckle 58 which secures with one of a plurality of recesses 60 on an opposing side of the strap 28. The size of the strap and how securely the strap 28 is releasably secured to the leg of the pilot is adjusted by securing the buckle 58 in a desired recess 60. To loosen the strap 28, the buckle 58 is secured in a recess 60 closer to the free end of the strap 28 and to tighten the strap 28, the buckle 58 is secured in a recess 60 closer to the end of the strap 28 connected to the base 62. Alternatively, any adjustable locking mechanism such as snaps, buttons, etc. may be used as long as they achieve the purpose of releasably securing the pilot pad 10 to the leg of a pilot in an adjustable manner.

A back view of the pilot pad 10 with the knee board 24 in an angled position is illustrated in FIG. 6. From this view the back side 68 of the knee board 24 is shown. Pivotally connected to the back side 68 of the knee board 24 is a V-shaped member 70. The V-shaped member 70 includes horizontal members 72 extending from a side thereof opposite the connection to the back side 68. The horizontal members 72 engage the recesses 66 on either side of the base 62 to retain the knee board 24 at a desired angle. In order to change the angle of the knee board 24, a user applies a pressure to both legs of the V-shaped member 70 causing the horizontal legs 72 to move towards each other. As the legs of the V-shaped member 70 move towards each other, the horizontal members 72 are released from within the recesses 66. The angle of the knee board 24 can then be adjusted to a desired angle. The legs of the V-shaped member are then released allowing the horizontal members 72 to enter another pair of recesses 66.

A side view of the pilot pad 10 with the knee board 24 in an angled position is shown in FIG. 8. The knee board 24 in a horizontal position is shown in dashed lines. The pivotal movement of the knee board 24 is indicated by the double sided arrow labeled with the numeral 74. The knee board 24 is able to pivot about the hinge 66 connecting the knee board 24 to the base 62. The recesses 66 in the base are positioned in aligned pairs on either side of the base for receiving the horizontal members 72 extending from the V-shaped member 70. By changing the pair of recesses 66 which receives the horizontal members 72, the angle of the knee board 24 with respect to the base 62 is also changed. The knee board 24 extends parallel to the base 62 when the horizontal members 72 are not engaged with any pair of recesses 66 and the V-shaped member lies against the back side 68 of the knee board 24.

The operation of the pilot pad 10 will now be described with reference to the figures. In operation, the pilot pad 10 is set up by entering of the aircraft type, tail number and ATIS in the spaces 48 adjacent the appropriate indicia 46 on the first horizontal line 40 on the top sheet 12. On the second horizontal parallel line 42, the ground, tower and approach/departure frequencies are entered in the spaces 52 adjacent the appropriate indicia 50 by the pilot. The altitude, heading and squawk number are then written in the spaces 56 adjacent the appropriate indicia 54 on the third horizontal parallel line 46 by the pilot. The information entered by the pilot relates to the flight about to be taken. The pilot will then secure the sheets 12 onto the knee board 24 beneath the clip 23. The pilot pad 10 is then secured onto the appropriate leg of the pilot using the adjustable latching mechanism. If the pilot writes with the left hand, the pilot pad 10 is secured to the left thigh and if the pilot writes with the right hand, the pilot pad 10 is secured to the right thigh. The pilot pad 10 is now in position and ready for when the pilot begins the flight.

During the flight, the pilot will take notes on the diagonal writing guide lines 22, while sitting in the seat 30 in the cockpit 32 of the aircraft 34, when flying in comfort and safety. The lines are spaced and extend at a twenty five to thirty five degree angle along the width of the sheet. The angle of the lines allows the pilot to write notes with a normal comfortable hand position without writing outside the lines. Thus the notes written by the pilot are legible. Upon completion of the flight, the notes taken by the pilot can be removed from beneath the clip 23 and placed in the pilots log book. Upon preparing for subsequent flights the pilot will fill in the information as directed above on a clean sheet of the pilot pad 10 and follow the steps discussed above.

From the above description it can be seen that the pilot pad of the present invention is able to overcome the shortcomings of prior art devices by providing a pilot pad which is able to provide a writing surface for a pilot which is readily accessible, unobtrusive and can be adjusted to sit at an angle to the leg of the pilot thus conforming with a comfortable writing position for the pilot. The pilot pad includes a heading with a visual flight rules/instrument flight rules form with spaces to put in aircraft type, tail number, ATIS, ground tower, approach/departure frequencies, altitude, heading and a squawk number on each sheet of paper and lines printed on each of the sheets of paper which extend at a diagonal to the sides of the pad whereby the pilot need not contort a writing arm to write legibly within the lines on the pad, the lines preferably extending at an angle of between twenty five to thirty five degrees from the horizontal for either a right handed or left handed pilot so that the pilot can comfortably take notes while sitting in a cockpit of an aircraft when flying. The pilot pad includes an angularly adjustable knee board strapped to the pilot's leg for providing a flat rigid surface on which the pilot can write. The pilot pad is also able to reduce crew fatigue and minimize wrist strain caused by conventional arm pads used by pilots and thereby free the arms of the pilot to operate the throttle, flaps, trim inputs and other aircraft operations and is able to be positioned on a knee of the pilot without disrupting the position of the pilot's legs required to control the plane as the legs of the pilot are brought together so that the knee's are about six inches apart for accessing the aircraft's rudder controls. Furthermore, the pilot pad of the present invention is simple and easy to use and economical in cost to manufacture.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that other can, by applying current knowledge, readily adapt it for various application without omitting features that, from the standpoint of prior art, fairly constitute essential characteristics of the generic or specific aspects of this invention.

What is claimed is new and desired to be protected by Letters Patent is set forth in the appended claims:

1. A pilot pad comprising:

a) a plurality of sheets adapted to be written upon, each of said plurality of sheets having a plurality of spaced diagonal writing guide lines extending across a width of said respective sheet;

b) a base section including a base and a knee board connected to said base in an angularly adjustable manner;

c) a clip connected to said base section for selectively securing said plurality of sheets to said knee board, said base section further including a V-shaped member pivotally connected to a side of said knee board opposite said plurality of sheet for retaining said knee board at an angle to said base; and d) a latching mechanism for securing said base section to a leg of a user whereby the user is able to write notes between said plurality of lines on a top one of said plurality of sheets while seated with an arm in a comfortable writing position.

2. The pilot pad as recited in claim 1, wherein each of said plurality of sheets is rectangular in shape with said plurality of lines on each sheet extending upward from a left side of said sheet to a right side to accommodate a writing style of a person writing with a right hand.

3. The pilot pad as recited in claim 1, wherein said plurality of lines on each sheet extending downward from a left side of said sheet to a right side to accommodate a writing style of a person writing with a left hand.

4. The pilot pad as recited in claim 1, wherein each of said plurality of sheets has a size of substantially five and three quarter inches in width by substantially seven and three quarter inches in length.

5. The pilot pad as recited in claim 1, wherein said plurality of lines on each of said plurality of sheets is inclined at an angle of between substantially twenty five to substantially thirty five degrees to the top and bottom edges.

6. The pilot pad as recited in claim 1, wherein each of said plurality of sheets further includes a heading printed near a top edge thereof.

7. The pilot pad as recited in claim 6, wherein said heading is a visual flight rules/instrument flight rules form.

8. The pilot pad as recited in claim 6, wherein said heading includes first, second and third horizontal parallel lines extending.

9. A pilot pad as recited in claim 8, wherein said first horizontal parallel line of said heading includes a first set of indicia to indicate aircraft type, tail number and ATIS, with spaces next to each of said first set of indicia.

10. The pilot pad as recited in claim 8, wherein said second horizontal parallel line of said heading includes a second set of indicia to indicate ground, tower and approach/departure frequencies, with spaces next to each of said second set of indicia.

11. The pilot pad as recited in claim 8, wherein said third horizontal parallel line of said heading includes a third set of indicia to indicate altitude, heading and squawk number, with spaces next to each of said third set of indicia.

12. The pilot pad as recited in claim 1 wherein said V-shaped member includes a horizontal member extending from an end thereof opposite said connection with said knee board and said base includes a plurality of recesses therein for releasably receiving said horizontal member to retain said knee board at a desired angle.

13. The pilot pad as recited in claim 1, wherein said latching mechanism includes a first strap connected to said base section at a first end and having a buckle at a second end thereof and a second strap connected to an edge of the base member opposite said first strap and including a plurality of spaced recesses extending along a length thereof for receiving said buckle therein.

* * * * *